US005704699A

United States Patent [19]

Pagelow et al.

[11] Patent Number: 5,704,699

[45] Date of Patent: Jan. 6, 1998

[54] MODULAR CABINET SYSTEM

[75] Inventors: Stephen W. Pagelow; John E. Whalen; Daniel R. Bullis, Jr.; Douglas E. Seals, all of Madison, Wis.

[73] Assignee: Trätec Products, Inc., Sun Prairie, Wis.

[21] Appl. No.: 687,753

[22] Filed: Jul. 25, 1996

[51] Int. Cl.[6] ..... A47B 47/00

[52] U.S. Cl. ..... 312/257.1; 312/111; 312/265.3

[58] Field of Search ..... 312/107, 108, 312/111, 265.1, 265.2, 265.3, 265.4, 263, 198, 257.1; 403/403, 231, 381

[56] References Cited

U.S. PATENT DOCUMENTS

| | | | |
|---|---|---|---|
| 835,508 | 11/1906 | Faust et al. | 312/108 |
| 2,003,633 | 6/1935 | Johnston . | |
| 2,674,769 | 4/1954 | Carisi | 312/257.1 X |
| 2,987,356 | 6/1961 | Simpson, Jr. . | |
| 3,347,610 | 10/1967 | Pilliod | 312/108 X |
| 3,602,567 | 8/1971 | Schnell et al. . | |
| 3,835,354 | 9/1974 | Torres-Pena . | |
| 3,945,696 | 3/1976 | Yellin | 312/265.2 |
| 3,964,810 | 6/1976 | Murphy | 312/111 X |
| 4,171,150 | 10/1979 | Söderlund . | |
| 4,290,710 | 9/1981 | Waller | 312/111 X |
| 4,371,221 | 2/1983 | Citterio . | |
| 4,396,241 | 8/1983 | Winn . | |
| 4,447,096 | 5/1984 | Perl et al. . | |
| 4,468,067 | 8/1984 | Jenkins . | |
| 4,632,473 | 12/1986 | Smith . | |
| 4,660,725 | 4/1987 | Fishman et al. | 312/111 X |
| 4,836,626 | 6/1989 | Taylor et al. . | |
| 4,859,008 | 8/1989 | Eyre et al. . | |
| 5,492,399 | 2/1996 | Tillack . | |

FOREIGN PATENT DOCUMENTS

| | | | |
|---|---|---|---|
| 1032892 | 6/1966 | United Kingdom | 312/111 |

*Primary Examiner*—Peter M. Cuomo
*Assistant Examiner*—Janet M. Wilkins
*Attorney, Agent, or Firm*—Welsh & Katz, Ltd.

[57] ABSTRACT

A modular easily assembled cabinet system includes components in kit form including generally rectangular base, top, side and back members, and four elongated corner post or upright members. The corner post members each define an external longitudinal corner and internally facing longitudinal channels. The opposite ends of each post member define connector ends having transverse recesses adapted to receive tongue portions of connector sites formed on each corner of the base and top members. During assembly, vertical lateral edges of the side members are received within channels in the corner posts, and upper and lower edges are inserted into channels formed in the base and top members. Fasteners releasably secure the connector site tongues within the corner post recesses. A door may be hinged between the base and top members. The base, top and door may be formed of blow molded plastic, with the base and top members being configured to enable nesting of cabinets in vertically stacked relation. Additional features include slide drawers and shelves releasable mounted on laterally opposed rod-type horizontal guides.

32 Claims, 7 Drawing Sheets

MODULAR CABINET SYSTEM

BACKGROUND OF THE INVENTION

The present invention relates generally to modular cabinet systems, and more particularly to a novel cabinet system wherein components for a number of various modular cabinet configurations are provided in kit form and can be readily assembled by an unskilled person without the need for special tools.

Modular cabinet systems are known that enable a person to assemble one or more modular cabinet-type units or shelves of different designs from individual components. The assembled units can be used either singly or in an array for storage, display or the like either in the home or in a commercial establishment. See, for example, U.S. Pat. Nos. 3,602,567, 3,835,354, 4,171,150, 4,371,221, 4,396,241, 4,447,096, 4,468,067, 4,632,473, 4,836,626, 4,859,008 and 5,492,399. A drawback in many of the prior modular cabinet systems is that their degree of modularization is limited so that an individual user may be limited in the desired arrangement of components or may require parts or items to be made to fit a specific layout, thus increasing the cost of the overall system. A further drawback in the known modular cabinet systems is that they frequently do not lend themselves to modification after once being assembled, thereby limiting the possibility of change or replacement of existing elements to obtain a different modular design.

Thus, a modular cabinet system which can be easily assembled without special tools and which facilitates disassembly and rearrangement would provide greater flexibility in system design and enable modification to accommodate different uses.

SUMMARY OF THE INVENTION

One of the primary objects of the present invention is to provide a novel modular cabinet system which enables various components to be readily assembled by an unskilled person without the need for special tools.

A more particular object of the present invention is to provide a novel modular cabinet system wherein a number of components may be provided in kit form and assembled without special tools to provide a rigid generally rectangular cabinet construction having a base, a top, side walls and a rear wall and, optionally, a hinged front door, with the various components being maintained in assembled relation through upstanding corner posts having releasable connection to corner connector sites on the base and top members.

A still further object of the present invention is to provide a novel modular cabinet system for assembling a generally rectangular cabinet having generally rectangular base and top members, a pair of generally rectangular side members, a generally rectangular back member and four elongated corner posts or uprights each of which defines an external longitudinal corner and has opposite connector ends defining recesses formed to receive connector tongues formed at corner connector sites on the base and top members in a manner to facilitate connection by suitable fasteners, such as cap screws and nuts. The upright corner posts cooperate with the base and top members to receive the side members and back member in supporting relation. A door may be hinged to and between the base and top members to facilitate closing of an access opening in the forward face of the modular cabinet.

A feature of the modular cabinet system in accordance with the invention lies in forming the base and top members and upstanding corner posts from a suitable blow molded plastic so as to provide lightweight but structurally rigid components that, when assembled, provide a rigid framework to support the side and back panels, as well as hingedly supporting a front door operative to close a front access opening in the cabinet.

Another feature of the modular cabinet system in accordance with one embodiment of the invention lies in the provision of metallic open mesh type side members that carry drawer and shelf support rods enabling support of pull-out drawers and horizontal shelf members within the modular cabinet.

A further feature of the modular cabinet system in accordance with the invention lies in the provision of laterally opposite channels formed in the upper surface of the base member and along a rearward edge thereof which, when the cabinet components are assembled, lie in vertically aligned relation with similar channels formed in the lower surface of the top member so as to receive generally horizontal lower and upper edges of the side and back members. The upstanding corner posts cooperate with vertical lateral edges of the side and back members to provide further rigidity to the assembled cabinet.

Further objects, advantages and features of the invention will become apparent from the following detailed description when taken in conjunction with the accompanying drawings wherein like reference numerals designate like elements throughout the several views.

DETAILED DESCRIPTION

Figure 1:
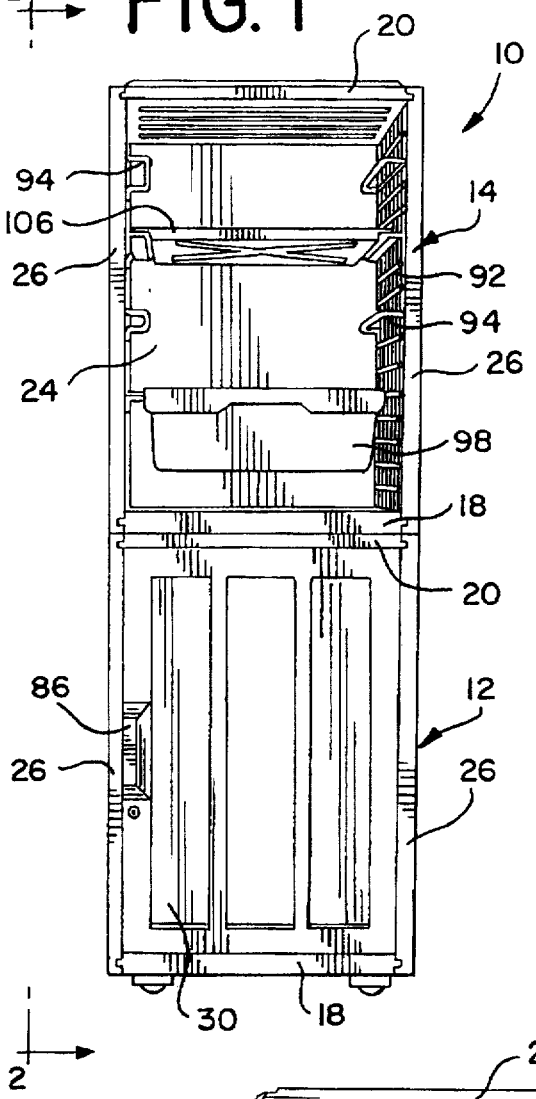
FIG. 1 is a front elevational view of a pair of vertically stacked modular cabinets constructed in accordance with the present invention.
Figure 2:
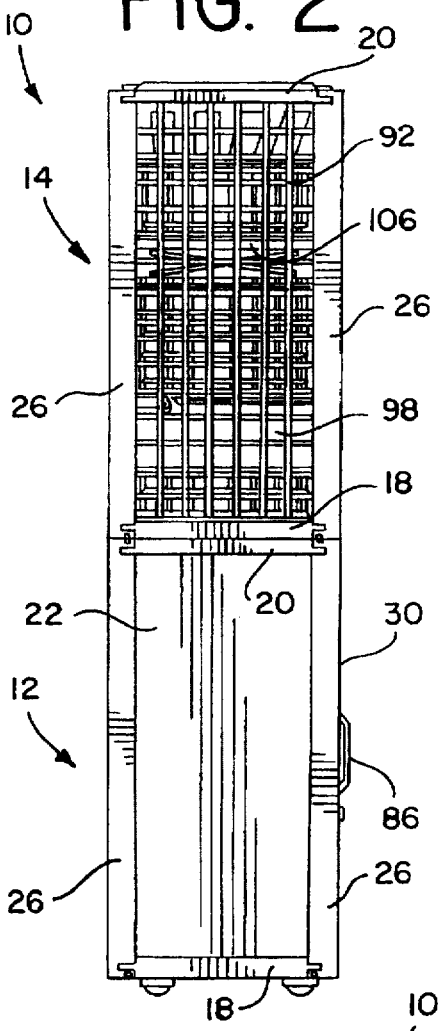
FIG. 2 is a left-hand side elevational view of the stacked cabinets shown in FIG. 1 taken along line 2—2 of FIG. 1.
Figure 3:
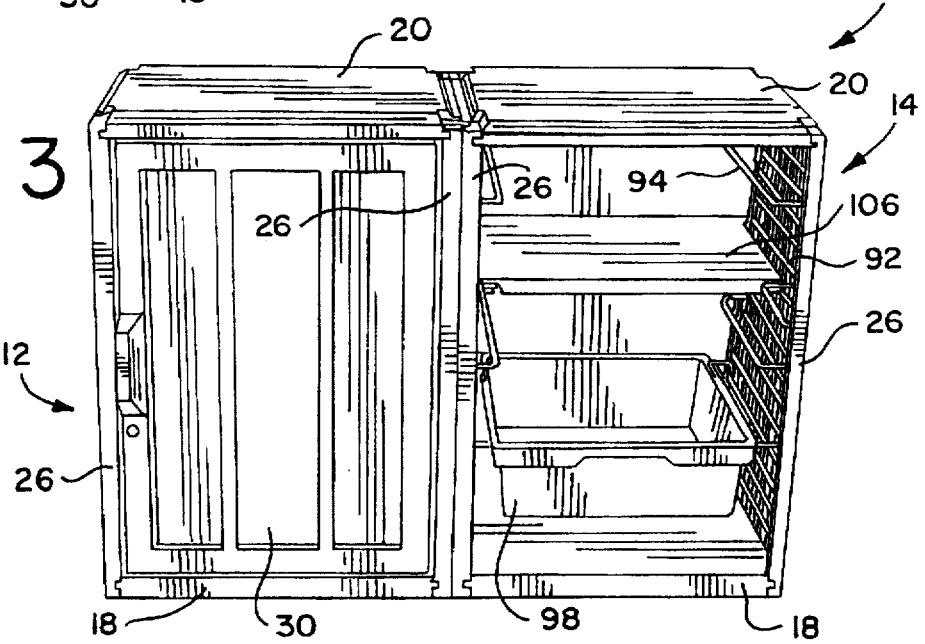
FIG. 3 is a front perspective view showing the modular cabinets of FIG. 1 in side-by-side relation.
Figure 6A:
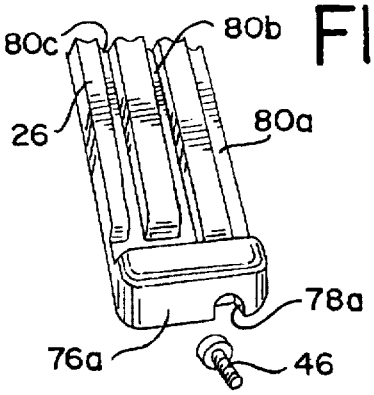
FIGS. 6A and 6B are fragmentary perspective views of an elongated corner post as employed in the modular cabinets of FIGS. 1–3.

Referring now to the drawings, and in particular to FIGS. 1–3, a modular cabinet system constructed in accordance with the present invention as indicated generally at 10. In the illustrated embodiment, the modular cabinet system 10 includes a base cabinet 12 and an upper cabinet 14 which, as will be described, are adapted to be stacked in vertically nested relation, as illustrated in FIGS. 1 and 2, or supported in side-by-side relation as illustrated in FIG. 3. The various components comprising the lower and upper cabinets 12 and 14 are generally similar but may be varied in size to create cabinets of different height, width and depth. Briefly, each of the lower and upper cabinets 12 and 14 includes a generally rectangular base member 18, a generally rectangular top member 20, a pair of generally rectangular side members or panels, one of which is indicated at 22 in FIG. 2, a generally rectangular back member or panel 24, and four substantially identical upstanding corner posts or uprights 26. As will be described, the opposite ends of the corner posts 26 have connector ends formed thereon that are adapted for releasable attachment to corner connector sites on the base member 18 and top member 20 so as to provide a rigid framework for supporting the side panels 22 and back panel 24. In the illustrated embodiment, a door 30 is hingedly connected to and between the base and top members 18 and 20, respectively, so as to enable closing of an access opening on the forward face of the lower modular cabinet 12. A similar door could be provided on the upper modular cabinet 14 if desired.

Figure 7A:
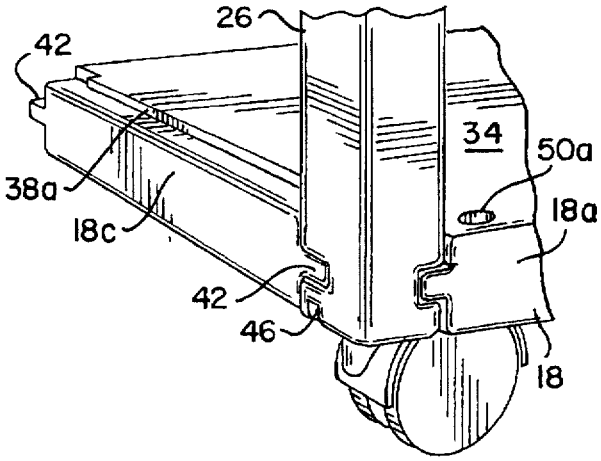
FIGS. 7A and 7B are fragmentary perspective views showing, respectively, the lower and upper connector ends of a corner post connected to corner connector sites on the base and top members and with the side and back panels removed.
Figure 9:
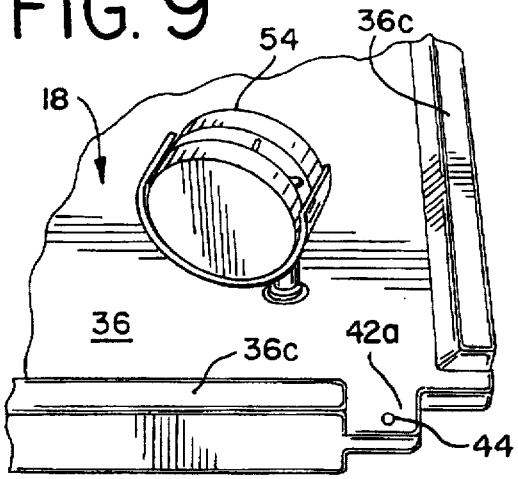
FIG. 9 is a fragmentary perspective view of the bottom surface of the base member showing a caster mounted thereon.
Figure 10:
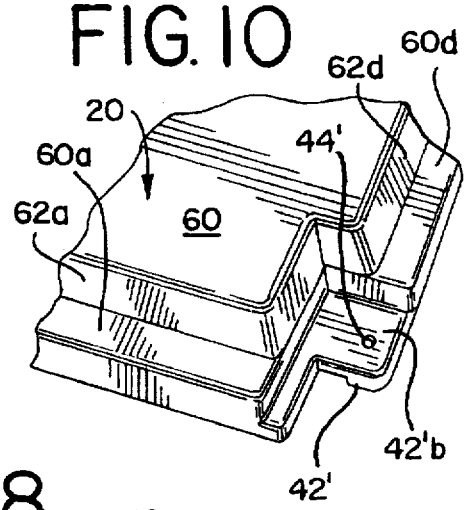
FIG. 10 is a fragmentary perspective view of the upper surface of the top member illustrating a corner connector site.
Figure 8:
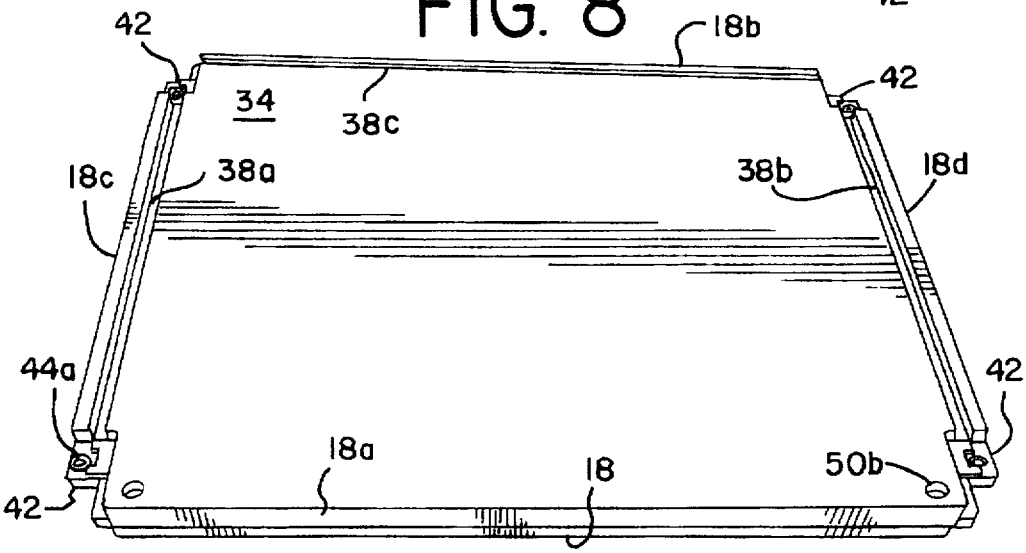
FIG. 8 is a perspective view of the base member employed in the modular cabinets of FIGS. 1–3.
Figure 11:
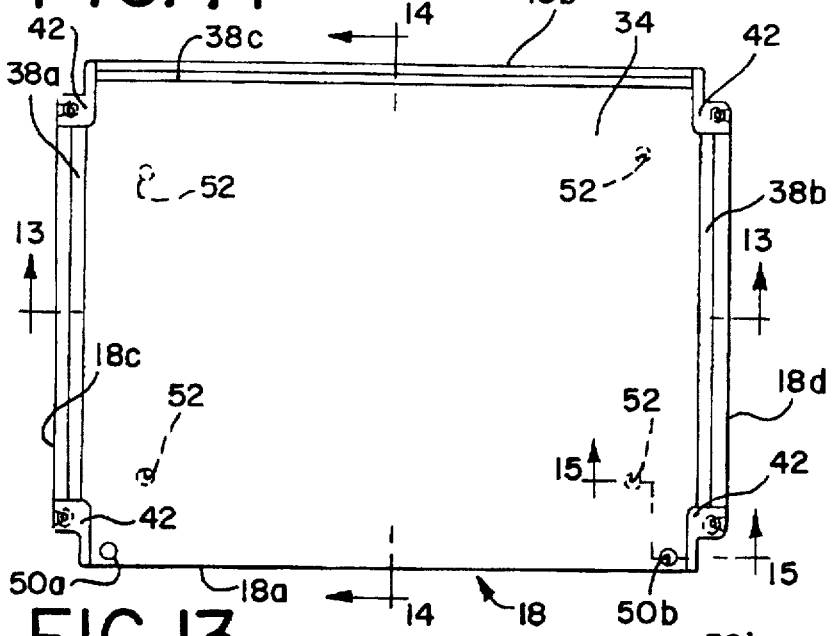
FIG. 11 is a plan view of the base member shown in FIG. 8.
Figure 14:
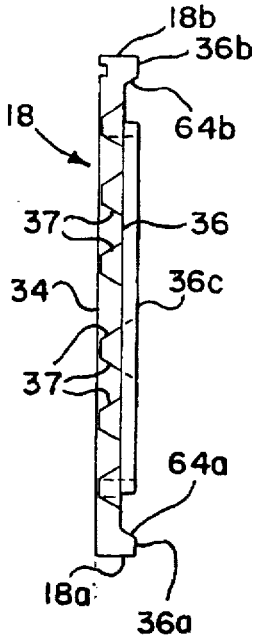
FIG. 14 is a vertical sectional view taken substantially along line 14—14 of FIG. 11.
Figure 13:
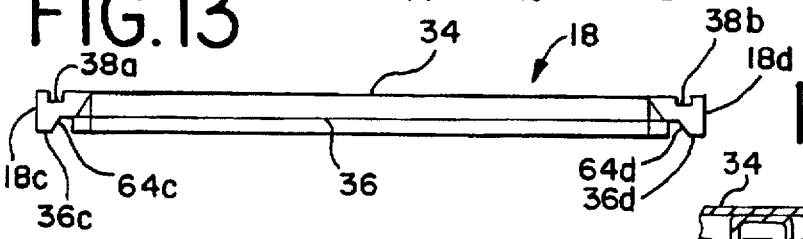
FIG. 13 is a vertical sectional view taken substantially along line 13—13 of FIG. 11.

Referring to FIGS. 11–16, taken in conjunction with FIGS. 7A, 8 and 9, the base member 18 may be made from a suitable blow molded plastic, such as high density polyethylene, and is of generally rectangular plan configuration having a front edge 18*a*, a rear edge 18*b* and laterally opposite side edges 18*c* and 18*d*. The base member 18 has a generally planar upper surface 34 and a lower surface 36 spaced from the upper surface and having transverse depressions so as to create reinforcing ribs or fins 37. The lower surface 36 is bounded along its forward and rearward edges by downwardly directed projections or ribs 36*a* and 36*b* (FIG. 14), and is bounded along its laterally opposite side edges by downwardly directed projections or ribs 36*c* and 36*d* (FIG. 13). As will be described, the projections or ribs 36*a,b* and 36*c,d* cooperate with surface 36 to facilitate nesting of a base member 18 with the upper surface of a top member 20 when the modular cabinets are in stacked relation as in FIGS. 1 and 2.

The upper surface 34 of the base member 18 is bounded along its laterally opposite marginal edges 18*c,d* by rectilinear recesses or channels 38*a,b*, and along its rearward transverse marginal edge 18*b* by a similar recess or channel 38*c*. The channels 38*a–c* are spaced inwardly from their respective marginal edges to receive the lower horizontal edges of the side panels 22 and back panel 24 during assembly. As will be described, the laterally spaced channels 38*a* and 38*b* are sized to also receive the bottom transverse edges of wire mesh type side panels that may be used in place of the side panels 22 or may be used in conjunction with the side panels 22.

Figure 7B:
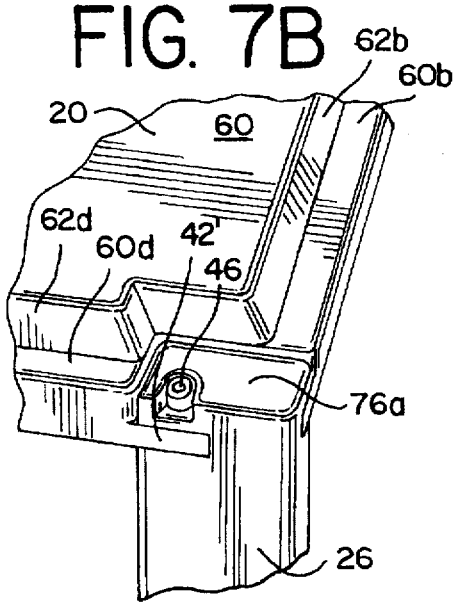
Figure 15:
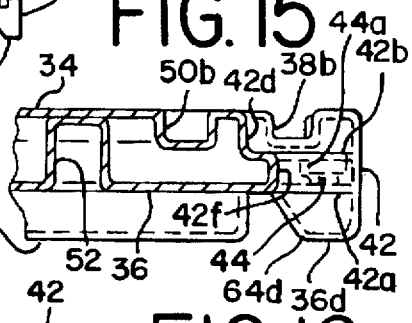
FIG. 15 is a fragmentary vertical sectional view, on an enlarged scale, taken generally along line 15—15 of FIG. 11.
Figure 12:
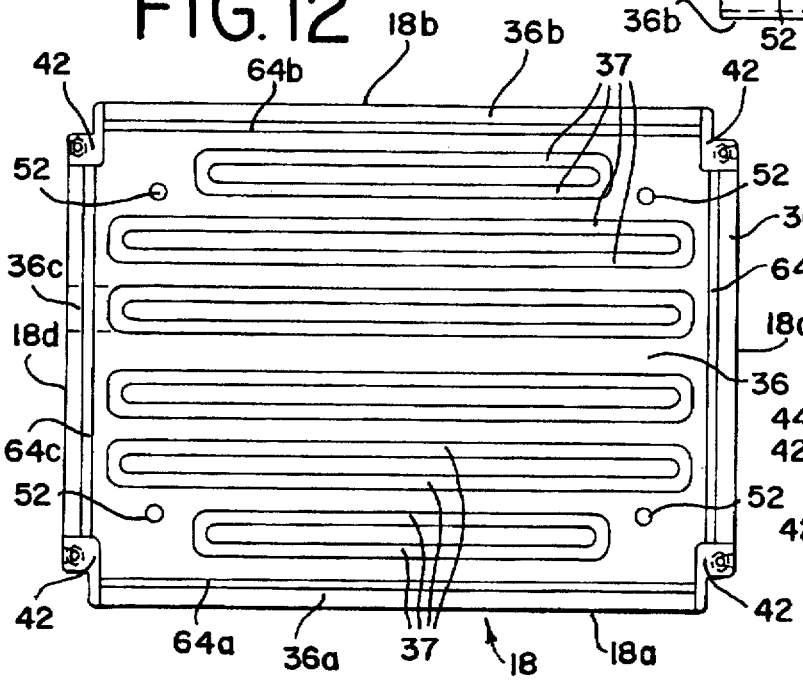
FIG. 12 is a bottom view of the base member of FIG. 11.
Figure 16:
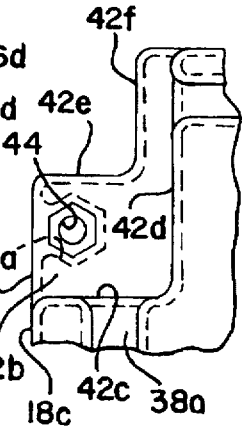
FIG. 16 is a fragmentary detail plan view, on an enlarged scale, of a corner connector site on the base member of FIG. 11.
Figure 17:
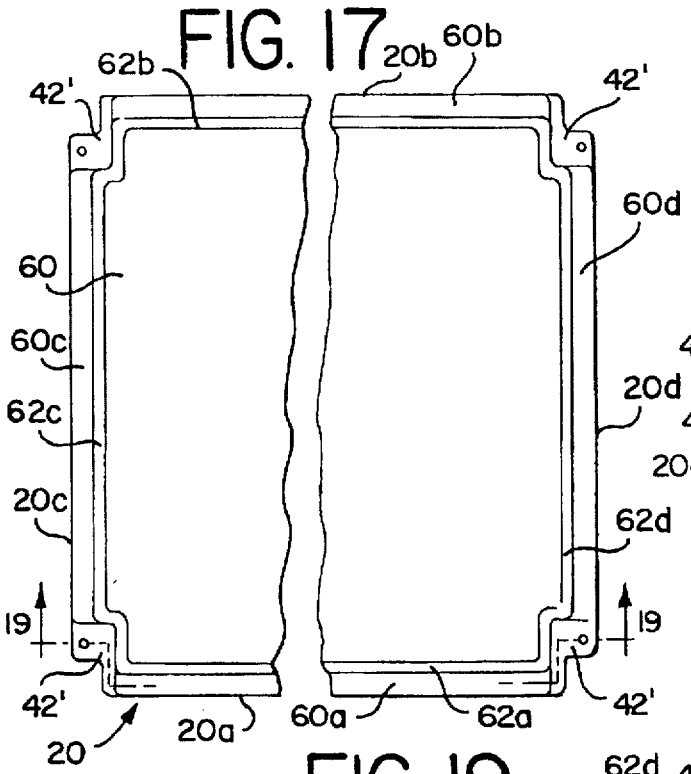
FIG. 17 is a foreshortened plan view of the top member employed in t e modular cabinets of FIGS. 1–3.

Referring to FIG. 15, taken in conjunction with FIGS. 11–14 and 16, each corner of the base member 18 defines a connector site having a connector tongue or member 42. Each connector tongue 42 has a lower surface 42*a* coplanar with the lower surface 36 of the base member, and has an upper surface 42*b* parallel to the lower surface 42*a* but spaced downwardly from the plane of the upper surface 34 of the base member. Each connector tongue 42 has a vertical height or thickness less than the vertical thickness of the base member so as to establish right-angle boundary surfaces 42*c* and 42*d* as shown in FIG. 16. Each connector tongue 42 is recessed at its outermost corner, as defined by edge surfaces 42*e* and 42*f*, and has a cylindrical bore 44 formed upwardly from its lower surface 42*a* that is axially aligned with and intersects a hexagonal shaped recess 44*a* formed in the upper surface 42*b*. The hexagonal recess 44*a* may open outwardly of the outer edge of the corresponding connector tongue and is sized to receive and prevent rotation of a nut for cooperation with a fastener screw, such as a cap screw as indicated at 46 in FIGS. 7A and 7B, when the base member 18 is connected to the upstanding corner posts 26.

A pair of cylindrical shaped recesses 50*a* and 50*b* are formed in the upper surface 34 of the base member adjacent the forward corner connector sites to facilitate pivotal mounting of a door 30. Four cylindrical recesses are formed in the bottom surface 36 of the base member, as indicated at 52, to receive support shafts or spindles on casters, one of which is indicated at 54 in FIG. 9.

FIGS. 17–21 illustrate the top member 20 which may also be made of a suitable blow molded plastic, such as high density polyethylene. The top member is similar in rectangular plan configuration and size to the base member 18 and has forward and rearward marginal edge surfaces 20*a* and 20*b* and laterally opposite side edge surfaces 20*c* and 20*d*. The top member 20 has an upper planar surface 60 that is bounded along its forward and rearward edges by marginal surfaces 60*a* and 60*b* and along its laterally opposite side edges by marginal surfaces 60*c* and 60*d*. The marginal surfaces 60*a–d* are coplanar and spaced from the planar surface 60 by inclined surfaces 62*a–d*, respectively. The inclined surfaces 62*a–d* are adapted to be engaged by similarly inclined surfaces 64*a–d* formed at the periphery of the lower planar surface 36 on the base member 18 so as to facilitate nesting of the base member on the top member 20 when in vertically stacked relation thereon. The nesting arrangement prevents lateral movement of an upper modular cabinet member relative to an underlying base cabinet.

Figure 19:
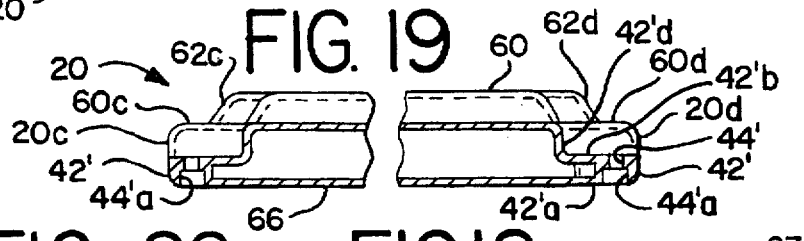
FIG. 19 is a foreshortened vertical sectional view, on an enlarged scale, taken substantially along line 19—19 of FIG. 17.
Figure 20:
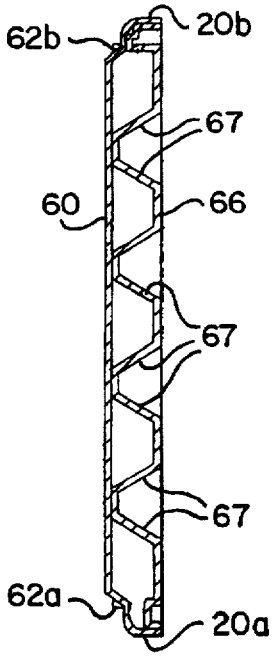
FIG. 20 is a vertical sectional view taken substantially along line 20—20 of FIG. 18, looking in the direction of the arrows.
Figure 18:
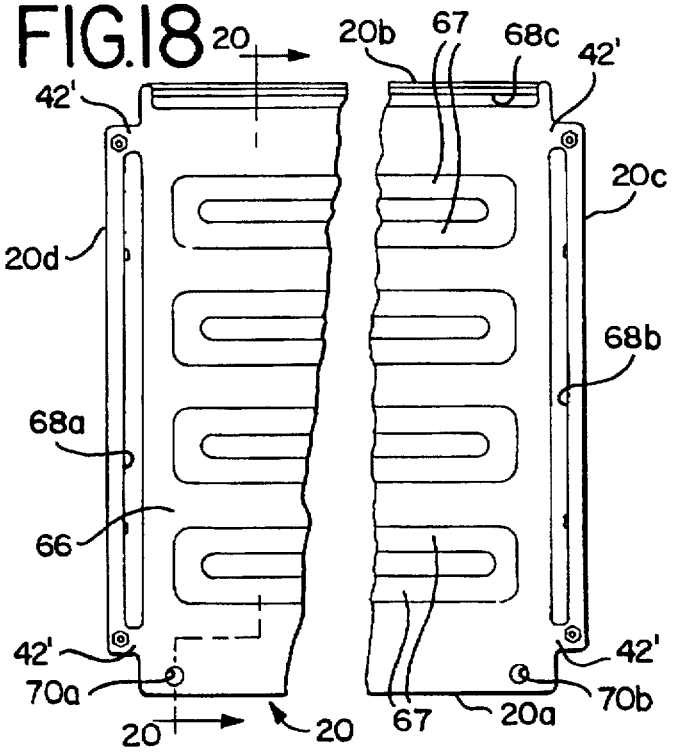
FIG. 18 is a foreshortened bottom view of the top member illustrated in FIG. 16.
Figure 22:
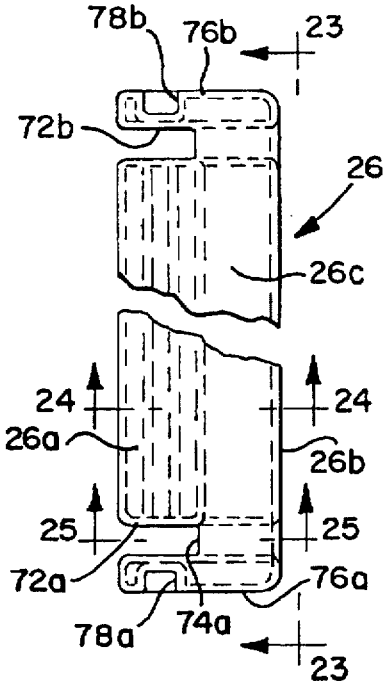
FIG. 22 is a foreshortened side view of the corner post or upright illustrated in FIGS. 7A and 7B.
Figure 23:
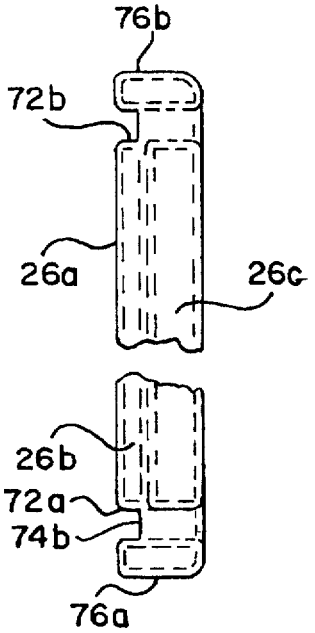
FIG. 23 is a foreshortened view of another side of the corner post of FIG. 22, taken along line 23—23 of FIG. 22.

As illustrated in FIGS. 18 and 20, the top member 20 has a lower surface 66 spaced from the upper surface 60 and having a plurality of transverse depressions therein that establish reinforcing ribs 67 to provide a lightweight, rigid relatively high strength top member. A pair of laterally opposite channels 68*a* and 68*b* are formed in the lower surface 66 of the top member 20, as shown in FIGS. 18 and 19, spaced inwardly from the lateral side edges 20*c* and 20*d* of the top member. A similar rear transverse channel 68*c* is formed along the rear edge 20*b* of the top member. The channels 68*a–c* are similar in size to the corresponding channels 38*a–c* in the base member 18 and are positioned to vertically overlie the channels 38*a–c* when the base and top members are attached to the corner posts. The lower surface 66 of the top member 18 also has a pair of generally cylindrical hinge pin recesses 70*a* and 70*b* formed adjacent the forward corners so as to overlie the recesses 50*a* and 50*b* in the base member for receiving hinge pins on the door 30.

Figure 21:
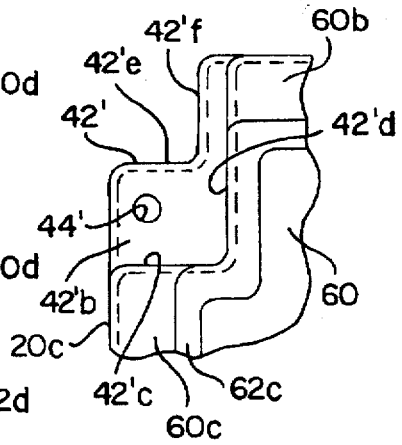
FIG. 21 is a fragmentary detail plan view similar to FIG. 16 illustrating a representative corner connector site on the top member.

Each corner of the rectangular top member 20 defines a connector site substantially identical to the connector sites formed at the corners of the base member 18. Thus, as illustrated in FIGS. 19 and 21, each corner connector site on the top member 20 has a connector tongue 42' having a lower surface 42'*a* coplanar with the lower surface 66 of the top member, and having an upper surface 42'*b* spaced downwardly from the plane of the marginal surfaces 60*a–d* so that the connector tongue 42' has a vertical thickness substantially equal to the thickness of the connector tongues 42. Each connector tongue 42' has a hexagonal shaped recess 44'*a* formed in its lower surface 42'*a* which is coaxial with and intersected by a cylindrical bore 44' formed in the upper surface 42'*b* of the connector tongue to accommodate a fastener screw and nut in similar fashion to the connector tongues 42.

Figure 24:
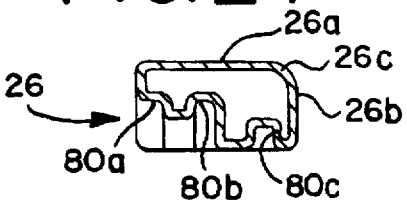
FIG. 24 is a transverse sectional view taken substantially along line 24—24 of FIG. 22.
Figure 25:
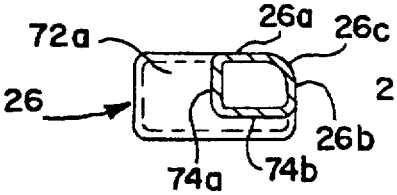
FIG. 25 is a transverse sectional view taken substantially along line 25—25 of FIG. 22.

FIGS. 22–26 illustrate a representative one of the four corner posts or uprights 26 which interconnect the base member 18 and top member 20 to provide a rigid framework. The corner posts 26 may also be formed from a suitable blow molded plastic to provide structurally rigid but lightweight members. Each corner post 26 has outer generally planar longitudinal surfaces 26*a* and 26*b* which are disposed at generally right angles to each other and interconnected through a radius corner edge 26*c* which forms a longitudinal outer corner of the corner post. The opposite ends of each corner post define connector ends each of which has a transverse slot, as indicated at 72*a* and 72*b*, to snugly receive a connector tongue 42 or 42' on the base member 18 and top member 20, respectively. As shown in FIG. 25, each recess 72*a* and 72*b* has an inner boundary defined by surfaces 74*a* and 74*b* formed at right-angles to each other and sized to be closely confronted by edge surfaces 42*e* and 42*f*, respectively, of a connector tongue 42 or 42' when inserted and secured within a recess 72*a* or 72*b* of a corner post.

The opposite ends of each corner post have transverse end surfaces 76*a* and 76*b* each of which has a recess formed therein as indicated at 78*a* and 78*b*. Each recess 78*a,b* opens outwardly of the outer sidewall 26*a* and communicates with the corresponding recess 72*a,b* through a bore so as to enable a fastener, such as a cap screw, to be inserted into the recess with its threaded shank extending into the recess 72*a* or 72*b* and with the head of the screw received within the corresponding recess 78*a,b*. The recesses 78*a* and 78*b* thereby allow a connector screw to be inserted through the bottom and top of an upstanding corner post 26 and connected to a polygonal shaped nut seated within the recess 44*a* or 44'*a* within a connector site tongue 42 and 42' on the base and top members when inserted into the recesses 72*a,b* in a corner post.

As illustrated in FIG. 24, each of the corner posts 26 has a plurality of longitudinal extending channels formed along its length facing inwardly from the outer planar surfaces 26*a* and 26*b*, as indicated at 80*a*, 80*b* and 80*c*. As will be described, the recesses 80*a–c* facilitate retention of vertical lateral marginal edges of the side and back panels 22 and 24, and also the vertical lateral marginal edges of open wire mesh type panels to be hereinafter described, when the various components of a modular cabinet 12 or 14 are in assembled relation. To this end, the channels 80*a–c* extend substantially the full length of the corner post between its corresponding transverse recesses 72*a* and 72*b*.

Figure 28:
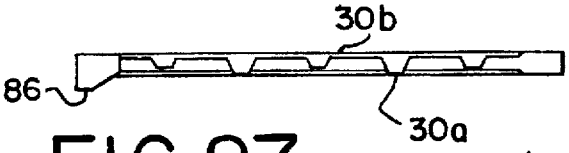
FIG. 28 is a transverse sectional view of the door taken substantially along line 28—28 of FIG. 27.
Figure 27:
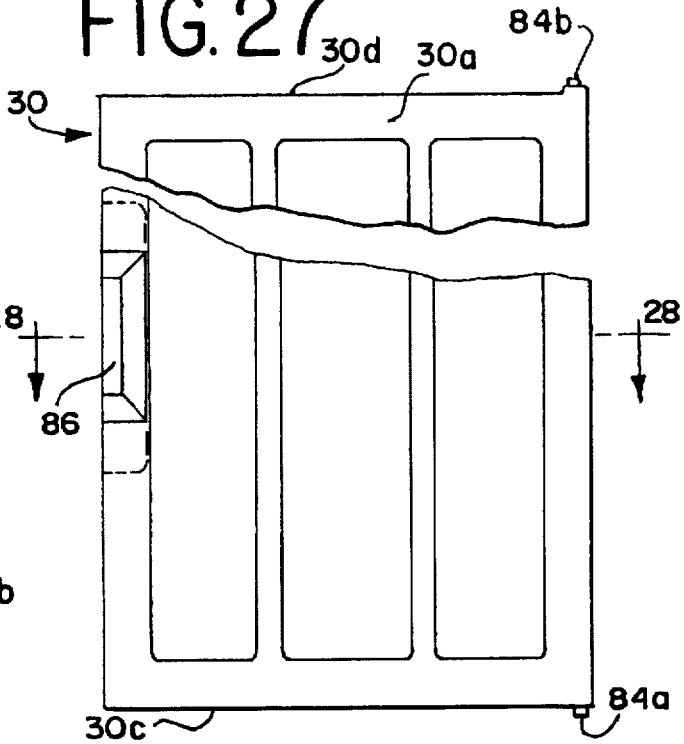
FIG. 27 a foreshortened elevational view of the door illustrated in FIG. 1 showing the lower hinge pin.
Figure 26:
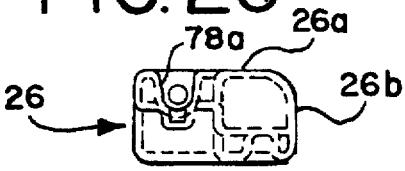
FIG. 26 is an end view of the corner post of FIG. 22.

FIGS. 27 and 28 illustrate the door 30 which may be hingedly connected between the base member 18 and top member 20 to provide access to or closure of an entry opening into an assembled modular cabinet. The door may also be made from a suitable blow molded plastic. In the illustrated embodiment, the door 30 has a forward wall 30*a* and a rear wall 30*b* both of which have inward depressions or panel portions to provide rigidity and styling. The rectangular door has lower and upper transverse edges 30*c* and 30*d* and has a pair of axially aligned cylindrical hinge pins or stub shafts 84*a* and 84*b* formed adjacent a vertical edge of the door. The hinge pins are sized to be received within a pair of axially aligned cylindrical hinge recesses 50*a,b* and 70*a,b* formed in the base member 18 and top member 20 depending on whether a right-hand or left-hand hinge axis is desired. Preferably, a handle 86 is formed on the door mid-length of its height to enable mounting as a left-hand or right-hand hinge axis. A key lock may also be provided on the door if desired.

Figure 29:
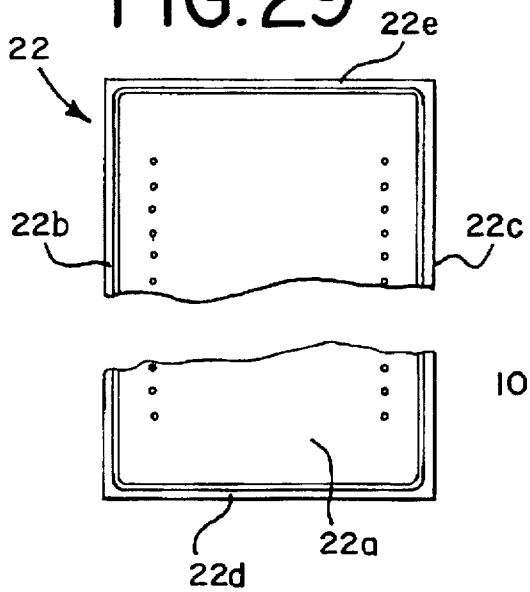
FIG. 29 is a foreshortened elevational view of the side wall or panel removed from the modular cabinet.
Figure 30:
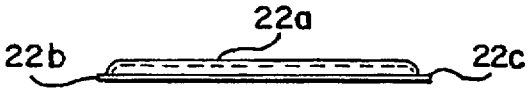
FIG. 30 is an end view of the side panel of FIG. 29.

FIGS. 29 and 30 illustrate a side wall or panel 22 that is preferably made of a suitable rigid plastic. The side panel 22 is generally rectangular and has an outer planar surface 22*a* bounded by first vertical marginal side edges 22*b* and 22*c* and second lower and upper edges 22*d* and 22*e* transverse to the side edges. The marginal edges 22*b–e* lie in a plane spaced from the plane of the outer surface 22*a*. One or more parallel rows of generally equidistantly vertically spaced openings may be provided along the length of the side panel to accommodate hanging of wire type hangers or hooks internally and externally of the modular cabinet. Each side panel 22 is sized so that when a base member 18 has it four corner connector sites connected to the lower ends of four corner posts 26, a side panel may be inserted downwardly between each forward and rear pair of corner posts with the lower edge 22*d* of the side panel inserted into the corresponding channel 38*a* or 38*b* in the upper surface 34 of the base member. The upstanding lateral marginal side edges 22*b* and 22*c* of the side panel are received within mutually facing channels 80*a* of the corresponding side pair of corner posts. When the corner connector sites on a top member 20 are secured to the upper connector ends of the corner posts, the upper transverse marginal edge 22*e* of each side panel is received within the corresponding channel 68*a* or 68*b* formed in the lower surface 66 of the top member 20.

Figure 4:
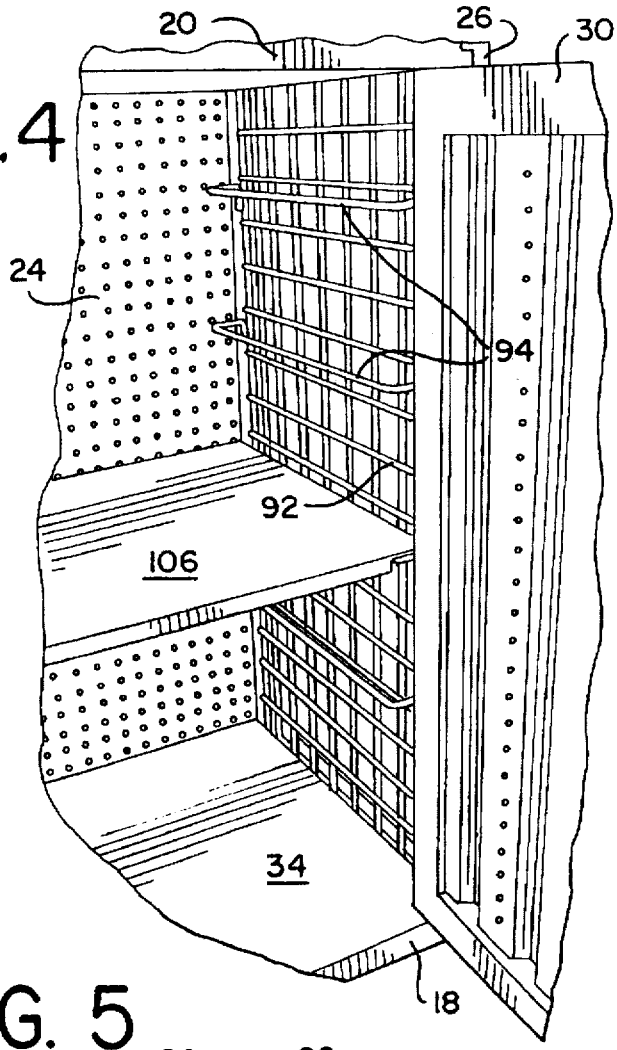
FIG. 4 is a fragmentary perspective view of the lower modular cabinet of FIG. 1 but with the door in an open position to expose an internal shelf.
Figure 6B:
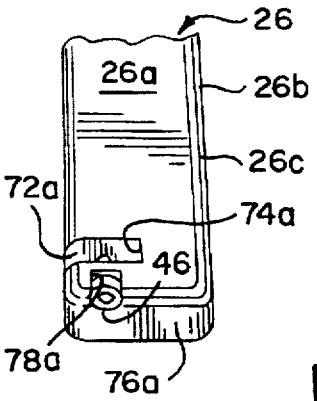
Figure 5:
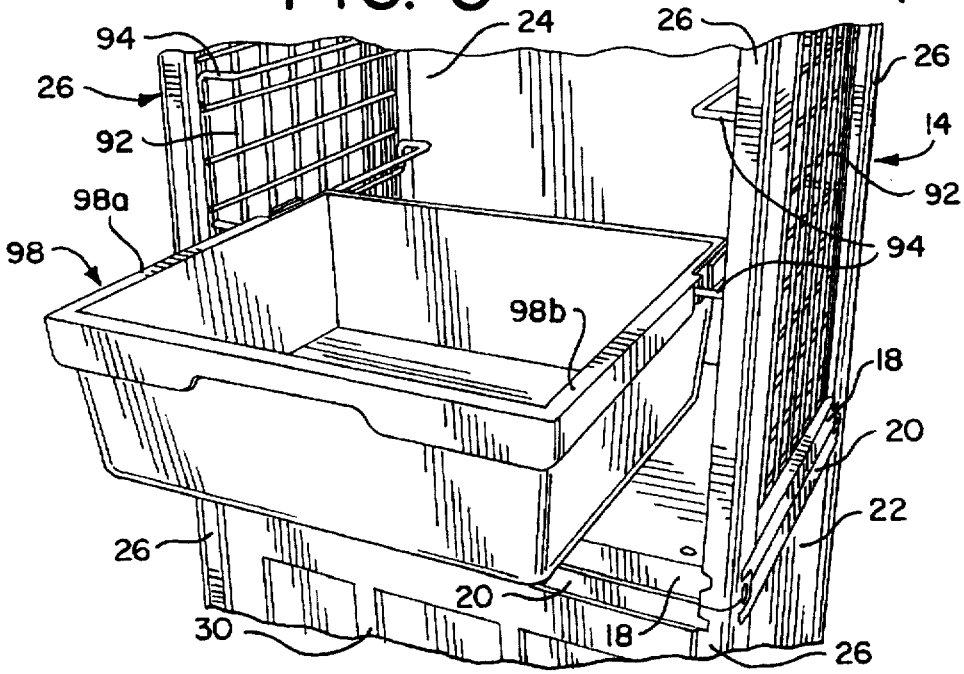
FIG. 5 is a fragmentary perspective view showing the pull-out drawer of FIG. 1 in a forward position.

The back member or panel 24 may be formed from a suitable hardboard, as illustrated in FIGS. 1 and 5, or from a conventional sheet of pegboard as illustrated in FIG. 4. The back member or panel 24 has a rectangular configuration and is dimensioned so that a lower horizontal or transverse marginal edge extends into the rear transverse channel 38*c* formed in the upper surface of the base member 18, and the upper horizontal or transverse marginal edge of the back panel extends into the transverse channel 68*c* formed in the lower surface of the top member 20. The rectangular back panel has a transverse width so that laterally opposite vertical edges of the back panel are received within mutually opposed longitudinal channels 80*c* in the rearward upstanding corner posts 26.

As illustrated in FIGS. 1–5, an open-mesh metallic wire type panel 92 is preferably supported inwardly of each side panel 22, or may be employed without use of the panels 22, as illustrated in the upper cabinet 14 of FIG. 2. The open-mesh wire type panels 92 are similar in size to the side panels 22 so that a bottom transverse marginal edge of a wire type panel 92 is received within the same channel 38*a* or 38*b* of the base member 18 as the lower edge of the corresponding panel 22. Similarly an upper horizontal or transverse marginal edge of each wire type panel 92 is received within the corresponding vertically aligned channel 68*a* or 68*b* in the lower surface of the top member 20. The laterally opposite vertical marginal side edges of the open-mesh wire type panels 92 are received within the channels 80*b* in the corresponding pairs of forward and rear corner uprights 26 along with the vertical edges of the side panels 22. The wire mesh panels 92 are assembled with the base member 18, top member 20 and corner posts 26 simultaneously with assembly of the side panels 22 and add significantly to the rigidity of the resulting modular cabinet, thereby preventing "racking".

Figure 31:
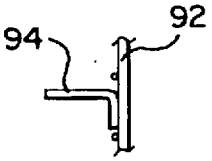
FIG. 31 is a fragmentary detail view illustrating the manner of mounting the drawer guide rods and shelf support rods on an open mesh type side wall.

Each of the open-mesh wire type panels 92 has a plurality of generally U-shaped guide rails 94 fixed thereon in laterally opposed pairs, such as illustrated in FIGS. 5 and 31. The guide rails 94 serve to support one or more drawers 98 as illustrated in FIGS. 1, 3 and 5. The drawers 98 may be formed of a suitable plastic, such as polyethylene, and have laterally outwardly extending flanges 98*a,b* formed along the longitudinal top edges of the drawer sidewalls. The flanges 98*a,b* extend from the forward end of the drawer and terminate short of the back wall. A depending retainer 100 is formed at the outer rear edge of each flange 98*a,b*. An outwardly extending rail guide 102 is formed on the rearward end of each drawer sidewall parallel to and spaced below the corresponding flange 98*a* or 98*b*. In this manner, the drawer may be tilted to enable releasably mounting on a pair of laterally spaced guide rails 94 for inward and outward sliding movement with the flanges 98*a,b* overlying the guide rails and the rail guides 102 underlying the guide rails.

Figure 34:
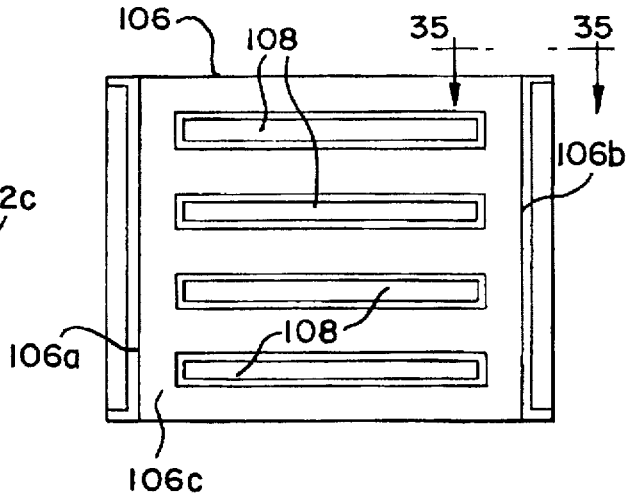
FIG. 34 is a bottom view of a shelf as shown in FIGS. 1 and 3.
Figure 35:
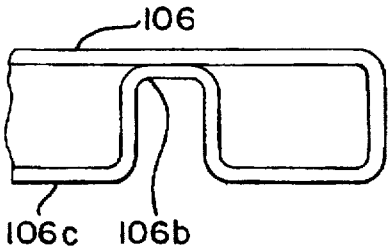
FIG. 35 is a fragmentary elevational detail view taken generally along line 35—35 of FIG. 34.

Each pair of laterally spaced guide rails 94 may also releasably support a shelf thereon as indicated at 106 in FIGS. 1, 3 and 4. As illustrated in FIGS. 34 and 35, each shelf 106 may be made of a suitable strength plastic, such as high density polyethylene, which lends itself to blow molding. Each shelf 106 has a pair of laterally opposite channels 106*a* and 106*b* formed in a lower surface 106*c* to receive a pair of laterally opposite guide rails 94, thereby releasably supporting the shelf within the corresponding modular cabinet. The channels 106*a,b* are configured to prevent horizontal movement of the shelf without lifting it vertically off the guide rails. The rigidity of the shelf 106 may be enhanced by forming depressed recesses in a lower surface 106*c* of the shelf, such as indicated at 108 in FIG. 34.

Figure 36:
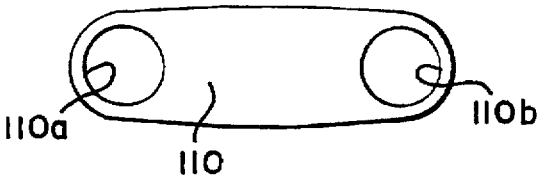
FIG. 36 is a plan view of a clip for connecting a pair of modular cabinets of substantially equal height in side-by-side relation.
Figure 32:
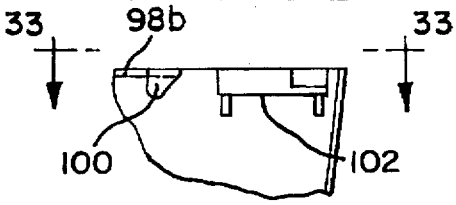
FIG. 32 is a fragmentary side elevational view of a drawer as illustrated in perspective in FIG. 5.
Figure 37:
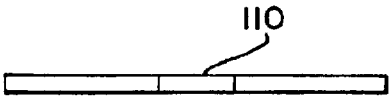
FIG. 37 is a side edge view of the clip of FIG. 36.
Figure 33:
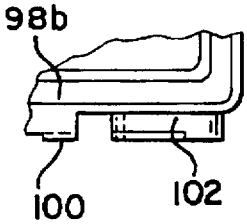
FIG. 33 is a fragmentary plan view taken substantially along line 33—33 of FIG. 32.

FIGS. 36 and 37 illustrate a connector bracket 110 that can be used to interconnect a pair of similar size modular cabinets, such as the lower and upper modular cabinets 12 and 14, in side-by-side relation when the casters are removed from the base member 18. The connector bracket 110 has its opposite ends configured to enable insertion of each end within a recess 78*a* or 78*b* formed in the upper end of a corner post 26. The connector bracket has openings 110*a* and 110*b* therethrough of a diameter sufficient to receive the shank of a connector screw when inserted within the recess 78*a* or 78*b* to interconnect the corner post with a corner connector site of the top member 20. With a pair of brackets 110 secured to the upper ends of forward and rear corner posts 26 on a modular cabinet, the outwardly extending end of each connector bracket can be similarly secured to an upstanding corner post of an adjacent modular cabinet to releasably interconnect the two modular cabinets.

Thus, in accordance with the present invention, a modular cabinet construction is provided which enables ready assembly of the various components without need for special tools. The base and top members 18 and 20, respectively, may have their corner connector site tongues readily connected to the lower and upper ends of four corner posts through fasteners, such as cap screws and nuts, thereby only requiring either an Allen type wrench or other simple screwdriver type drive. After connecting the lower ends of four corner posts to the corner connector sites on a base member 18, wire mesh type side panels 92 and, optionally, side panels 22 may have their lower ends positioned within the laterally spaced channels 38*a* and 38*b* in the upper surface of the base member, with the laterally opposite vertical marginal edges of the side panels disposed within the longitudinal channels 80*a* and 80*b* of the corresponding corner posts. Similarly, the lower edge of a back panel 24 has its lower edge positioned within the rear transverse channel 38*c* of the base member 18 with the vertical marginal edges of the back panel received within mutually opposed channels 80*c* in the rear corner posts 26. Thereafter, the top member 20 is releasably secured to the upper ends of the corner posts through insertion of the corresponding corner connector tongues 42' into the recesses 72*a* or 72*b* at the upper ends of the corner posts 26. Simultaneously, the upper edges of the side panels and back panel are inserted into the corresponding channels 68*a,b* and *c* formed in the lower surface of the top member 20. If desired, a door 30 may be assembled with its hinge pins 84*a* and 84*b* inserted within a selected pair of vertically aligned recesses 50*a,b* and 70*a,b* in the base member and top member as the top member is assembled to the upper ends of the corner posts. Sliding drawings and shelves may be supported on laterally opposed pairs of guide rails 94 on the side panels 92 within the assembled modular cabinet.

While a preferred embodiment of the present invention has been illustrated and described, it will be understood that changes and modifications may be made therein without departing from the invention in its broader aspects. Various features of the invention are defined in the following claims.

We claim:

1. A kit for making a modular cabinet comprising a generally rectangular base member, a generally rectangular top member, a pair of generally rectangular side members, a generally rectangular back member and four elongated corner posts, said side and back members having first marginal side edges and second marginal edges generally transverse to said side edges, each of said corner posts defining an external corner along the length of the post and having opposite connector ends, each of said connector ends having an end surface and a recess generally transverse to the longitudinal axis of the post and spaced from said end surface, said base member including corner connector sites each of which defines a connector tongue configured to be inserted into one of said transverse recesses in one of said corner post connector ends, each of said connector ends and each of said connector tongues being adapted to receive a fastener for releasably connecting one of said corner posts in upstanding relation to each corner connector site of said base member, said corner posts each having at least one longitudinal open channel so as to create mutually facing channels between laterally opposed front and rear pairs of upstanding corner posts for receiving said first marginal side edges of said side and back members in supporting relation when the kit is in assembled relation, said top member having corner connector sites substantially identical to the corner connector sites on said base member for connection to selected ones of said connector ends of said upstanding corner posts opposite said base member, said base and top members each having open channels formed therein for cooperation to receive said second marginal edges of said side and back members.

2. A kit as defined in claim 1 wherein said base and top members are adapted to cooperate with said laterally opposed front corner posts to define a generally rectangular access opening, and including a generally rectangular door adapted to be hingedly mounted within said front access opening.

3. A kit as defined in claim 1 wherein, when the kit is in assembled relation forming a first modular cabinet, said top member has an upper surface, and said base member has a lower surface, said lower surface of said base member being adapted to cooperate with a similar second cabinet including a substantially similar top member to facilitate stacking of the first cabinet in nested relation on the top member of the second cabinet so as to prevent relative lateral movement between the first and second cabinets.

4. A kit as defined in claim 3 wherein said lower surface of said base member has a generally rectangular shaped recess formed therein having a periphery defined by inclined marginal surfaces, said top member having a generally rectangular raised surface thereon configured to nest with a rectangular recess in a corresponding base member when the base member is mounted on the upper surface of the top member.

5. A kit as defined in claim 1 wherein, when the kit is in assembled relation, said base member has a lower surface, the lower surface having apertures therein for mounting casters or said lower surface.

6. A kit as defined in claim 1 wherein said side members are generally planar and have an array of apertures therein enabling mounting of hanging hooks on the side members.

7. A kit as defined in claim 1 wherein said side members are defined by open mesh metallic wire type panels having guide rods formed thereon so that pairs of laterally spaced mutually opposed guide rods are established internally of the modular cabinet when assembled to facilitate mounting of at least one slide drawer or shelf member thereon.

8. A kit as defined in claim 1 wherein said base member has a first surface having laterally opposite parallel side edges and having said open channels formed therein parallel to and spaced inwardly from said lateral side edges, said top member having a first surface having said open channels therein positioned to lie in substantially vertical alignment with said channels in said base member when said base and top members are fixed to opposite ends of said corner posts with their said first surfaces facing each other, said second marginal edges of said side members being adapted to be received within a pair of said vertically aligned channels in said base and top members.

9. A kit as defined in claim 8 wherein said open channels in said base and top members include transverse open channels so that said transverse channels lie in mutually opposed vertically aligned relation to each other when the kit is assembled, said second marginal edges of said back member being adapted for insertion within said vertically aligned transverse channels in said base and top members.

10. A kit as defined in claim 1 wherein said corner connector sites on said base and top members are defined in part by generally right-angle boundary surfaces configured to abut a longitudinal surface on the corresponding corner post when said connector tongues are inserted within said recesses in said corner posts and fixed therein.

11. A kit as defined in claim 1 wherein said base member, top member and corner posts are made from blow molded plastic.

12. A modular cabinet comprising, in combination, a generally rectangular base member, a generally rectangular top member, a pair of generally rectangular side members, a generally rectangular back member and four elongated corner posts, each of said corner posts defining an external corner along the length of the post and having opposite connector ends, each of said connector ends having an end surface and a recess generally transverse to the longitudinal axis of the post and spaced from said end surface, said base and top members including corner connector sites each of which defines a connector tongue configured to be inserted into one of said transverse recesses in one of said corner post connector ends, the connector tongue on each corner site of said base member being secured within one of said transverse recesses at lower ends of said corner posts when disposed in upstanding relation, said connector tongue on each corner site of said top member being secured within one of said transverse recesses at upper ends of said corner posts so that said top member overlies said base member, said corner posts each having longitudinal open channels so as to create mutually facing channels between laterally opposed front and rear pairs of upstanding corner posts, said side and back members having marginal vertical edges disposed in supporting relation within said channels.

13. A modular cabinet as defined in claim 12 wherein said base and top members cooperate with said laterally opposed front pair of corner posts to define a generally rectangular access opening, and including a generally rectangular door adapted to be hingedly mounted within said front access opening.

14. A modular cabinet as defined in claim 12 wherein said top member has an upper surface, and said base member has a lower surface, said lower surface of said base member being adapted to cooperate with an upper surface of a top member of a similar second cabinet to facilitate stacking of the cabinets in vertical nested relation in a manner preventing relative lateral movement between the cabinets.

15. A modular cabinet as defined in claim 12 wherein said base member has a lower surface having apertures therein for mounting casters on the lower surface of said base member.

16. A modular cabinet as defined in claim 12 wherein said side members are generally planar and have an array of apertures therein enabling mounting of hanging hooks on the side members.

17. A modular cabinet as defined in claim 12 wherein said side members are defined by open mesh metallic wire type panels having guide rods formed thereon so that pairs of laterally spaced mutually opposed guide rods are established internally of the modular cabinet to facilitate mounting of at least one slide drawer or shelf member thereon.

18. A modular cabinet as defined in claim 12 wherein said base member has an upper surface having laterally opposite parallel side edges and having open channels formed therein parallel to and spaced inwardly from said lateral side edges, said top member having open channels in a lower surface thereof so as to be in substantially vertical alignment with the channels in said base member, each of said side members having generally horizontal upper and lower marginal edges received within a corresponding pair of said vertically aligned channels in said base and top members.

19. A modular cabinet as defined in claim 12 wherein said base and top members have transverse open channels formed in upper and lower surfaces, respectively, thereof so that said transverse channels are disposed adjacent rearward transverse edges of said base and top members and lie in vertically aligned relation to each other, said back member having horizontal lower and upper marginal edges received within the vertically aligned transverse channels in said base and top members.

20. A modular cabinet as defined in claim 12 wherein said corner connector sites on said base and top members are defined in part by generally vertical marginal edges adjacent said connector tongues, said marginal edges being configured to abut a longitudinal external surface on the corresponding corner post when the tongues are inserted within said recesses in said corner posts.

21. A modular cabinet as defined in claim 20 wherein said transverse recesses in said corner posts have inner generally right-angle boundary surfaces defined by the corner posts, each of said connector tongues having outer edge surfaces configured to confront the right-angle boundary surfaces in the corresponding one of said transverse recesses into which the connector tongue is inserted and secured.

22. A modular cabinet as defined in claim 12 wherein said base member, top member and corner posts are made from blow molded plastic.

23. A kit for making a modular cabinet comprising a generally rectangular base member, a generally rectangular top member, a pair of generally rectangular side members, a generally rectangular back member and four elongated corner posts, said side and back members each having lateral marginal side edges and generally transverse marginal edges, each of said corner posts defining an external corner along the length of the post and having opposite connector ends, each of said connector ends having an end surface and a recess generally transverse to the longitudinal axis of the post and spaced from said end surface, said base member including corner connector sites each of which defines a connector tongue configured to be inserted into one of said transverse recesses in said corner post connector ends, each of said connector ends and each of said connector tongues being adapted to receive a fastener for releasably connecting one of said corner posts in upstanding relation to each corner connector site of said base member, at least some of said corner posts having means for cooperating with said marginal side edges of said side and back members in supporting relation therewith, said top member having corner connector sites including connector tongues substantially identical to the connector tongues on said base member for insertion into said transverse recesses in said upstanding corner posts opposite said base member, said base and top members having means for cooperating with said transverse marginal edges of said side and back members in supporting relation therewith.

24. A kit as defined in claim 23 wherein said corner posts define laterally opposed front and rear pairs of corner posts when the modular cabinet is assembled, said base and top members are adapted to cooperate with said laterally opposed front pair of corner posts to define a generally rectangular access opening, and including a generally rectangular door adapted to be hingedly mounted within said front access opening.

25. A kit as defined in claim 23 wherein, when the modular cabinet is assembled, said top member has an upper surface and said base member has a lower surface, said lower surface of said base member being adapted to cooperate with a similar second cabinet including a substantially similar top member to facilitate stacking of the first cabinet in nested relation on the top member of the second cabinet so as to prevent relative lateral movement between the first and second cabinets.

26. A kit as defined in claim 23 wherein said base member has a first surface having laterally opposite parallel side edges and having open channels formed therein parallel to and spaced inwardly from said lateral side edges, said top member having a first surface having open channels therein positioned to lie in substantially vertical alignment with said channels in said base member when said base and top members are fixed to opposite connector ends of said corner posts with their said first surfaces facing each other, said transverse marginal edges of said side members being adapted to be received within a pair of said vertically aligned channels in said base and top members.

27. A kit as defined in claim 23 wherein said corner connector sites on said base and top members are defined in part by generally right-angle boundary surfaces configured to abut a longitudinal surface on the corresponding corner post when said connector tongues are inserted within said recesses in said corner posts and fixed therein.

28. A kit as defined in claim 23 wherein said base member, top member and corner posts are made from blow molded plastic.

29. A modular cabinet comprising, in combination, a generally rectangular base member, a generally rectangular top member, a pair of generally rectangular side members, a generally rectangular back member and four elongated corner posts, said side and back members each having lateral marginal side edges and generally transverse marginal edges, each of said corner posts defining an external corner along the length of the post and having opposite connector ends, each of said connector ends having an end surface and a recess transverse to the longitudinal axis of the post and spaced from the end surface, said base and top members including corner connector sites each of which defines a connector tongue configured to be inserted into one of said transverse recesses in one of said corner post connector ends, the connector tongue on each corner site of said base member being secured within one of said transverse recesses at the lower end of one of said corner posts when disposed in upstanding relation, the connector tongue on each corner site of said top member being secured within one of said transverse recesses at the upper ends of said corner posts so that said top member overlies said base member, said corner posts each having means for cooperating with said marginal side edges of said side and back members in supporting relation therewith.

30. A modular cabinet as defined in claim 29 wherein said corner connector sites on said base and top members are defined in part by generally vertical marginal edges adjacent said connector tongues, said marginal edges being configured to abut a longitudinal external surface on the corresponding corner post when the tongues are inserted within said recesses in said corner posts.

31. A modular cabinet as defined in claim 30 wherein said transverse recesses in said corner posts have inner generally right-angle boundary surfaces, each of said connector tongues having outer edge surfaces configured to confront said right-angle boundary surfaces in the corresponding transverse recess into which the connector tongue is secured.

32. A modular cabinet as defined in claim 29 wherein said corner post means for cooperating with said marginal side edges of said side and back members include longitudinal open channels so as to create mutually facing channels between laterally opposed front and rear pairs of upstanding corner posts, said marginal side edges of said side and back members being disposed in supporting relation within said channels.

* * * * *